US006711778B2

(12) United States Patent
Sparkman

(10) Patent No.: US 6,711,778 B2
(45) Date of Patent: Mar. 30, 2004

(54) DOOR STOP APPARATUS

(76) Inventor: Benny W. Sparkman, P.O. Box 24711, Tempe, AZ (US) 85285

( * ) Notice: Subject to any disclaimer, the term of this patent is extended or adjusted under 35 U.S.C. 154(b) by 0 days.

(21) Appl. No.: 10/082,421

(22) Filed: Feb. 26, 2002

(65) Prior Publication Data

US 2003/0159244 A1 Aug. 28, 2003

(51) Int. Cl.[7] ..... E05F 5/02
(52) U.S. Cl. ..... 16/86 C; 16/82
(58) Field of Search ..... 16/86 C, 82, 86 R, 16/86 A, 86 B, 78

(56) References Cited

U.S. PATENT DOCUMENTS 1,313,612 A * 8/1919 Stoiber ..... 16/78
1,869,316 A * 7/1932 Robertson ..... 16/82
2,032,600 A * 3/1936 Smith ..... 16/86 C
2,291,412 A * 7/1942 Schonitzer ..... 16/86 C
2,321,409 A * 6/1943 Moore ..... 16/85
2,693,616 A * 11/1954 Cromwell et al. ..... 16/85
2,787,019 A * 4/1957 Galla ..... 16/85
2,860,369 A * 11/1958 Galla ..... 16/85
2,882,548 A * 4/1959 Roethel ..... 16/86 R
2,915,778 A * 12/1959 De Vito ..... 16/82
4,574,422 A * 3/1986 Dieudonne et al. ..... 16/85
4,833,755 A * 5/1989 Bonin ..... 16/344
4,858,952 A * 8/1989 Sasaki et al. ..... 280/802
5,074,010 A * 12/1991 Gignac et al. ..... 16/334
5,218,738 A * 6/1993 Krajenke ..... 16/334
5,444,894 A * 8/1995 Heiler ..... 16/262

* cited by examiner

*Primary Examiner*—Anthony Knight
*Assistant Examiner*—Michael J. Kyle
(74) *Attorney, Agent, or Firm*—H. Gordon Shields

(57) ABSTRACT

Door stop apparatus includes a block secured to a vehicle and a bar extending through a generally horizontal bore in the block. The bar is secured to a vehicle door and includes stop recesses spaced apart from each other. The bar extends through a cylinder a generally vertical bore in the block and the cylinder includes a biased roller which extends sequentially into the stop recesses on the bar to provide intermediate stops for the vehicle door. The cylinder pivots or rotates in the bore as the door moves.

9 Claims, 2 Drawing Sheets

DOOR STOP APPARATUS

BACKGROUND OF THE INVENTION

1. Field Of The Invention

This invention relates to apparatus for holding a door open and, more particularly, to apparatus for holding a vehicle door open at a plurality of stop locations.

2. Description of the Prior Art

U.S. Pat. No. 2,860,369 (Galla) discloses a vehicle door holding apparatus which includes an arm with a hook at the distal end of the arm. The hook limits the extend to which the door may open. The arm is pivotally secured to the door jam of the vehicle.

U.S. Pat. No. 4,829,633 (Kassner) discloses a hinge assembly for a vehicle door. The hinge assembly includes a spring for biasing a plate against balls retained in a cage. A hinge element includes depressions which receive the balls when the door is opened, and apply force to help limit the extent of the door opening.

U.S. Pat. No. 4,833,755 (Bonin) discloses a pivoting bar having a plurality of indentations on the bar for marking the location of a door relative to the structure to which the door is secured. The bar is pivotally secured to the body of the vehicle. Rollers on the door engage the bar. As the doors open, the rollers move into the indentations on the bar.

U.S. Pat. No. 5,054,165 (Marchione) discloses another hinge assembly for a vehicle door. The hinge assembly includes elements for allowing the door to be removed from the vehicle. The hinge assembly also holds the door open or in an open position.

U.S. Pat. No. 5,501,421 (Kluting) discloses apparatus for holding a door in an open position.

U.S. Pat. No. 5,474,244 (Lee) discloses another door limiting structure which includes a pivoting arm which extends between a pair of rollers. The apparatus is somewhat similar to the '755 (Bonin) structure discussed above in that rollers are biased against a bar, and the bar includes indentation elements which receive biased bars.

U.S. Pat. No. 5,862,570 (Lezuch & Allmacher) discloses a door checking apparatus which is similar to the '344 (Lee) patent discussed above. An arm is pivotally secured to the vehicle body, and the arm extends between balls and a guide member. The balls are disposed in grooves in the pivoting arm.

U.S. Pat. No. 5,873,622 (Kluting & Klingelhofer) discloses an adjustable lock system for a vehicle door. The structure includes a motor for actuating lock elements.

SUMMARY OF THE INVENTION

The invention described and claimed herein includes a block secured to a vehicle chassis adjacent to a door. A bar extends through the block and is secured to the vehicle door. The block includes a relatively wide door through which the bar extends. Within the block is a vertical bore in which is disposed a roller. The bar extends through the roller and the roller moves or pivots on a vertical axis as the door moves between its closed position and its open position. Included in the bar are depressions or relieved areas and within the cylinder is a spring biased roller. The roller extends into the depressions on the bar to define stop locations for the door.

Among the objects of the present invention are the following:

To provide new and useful door stop apparatus;

To provide new and useful door stop apparatus for a vehicle;

To provide new and useful door stop apparatus including a bar secured to a vehicle door;

To provide new and useful stop apparatus for a vehicle door including a bar having a plurality of depressions which define stop positions for the door;

To provide new and useful door stop apparatus including a block secured to a vehicle and a bar extending through the block; and To provide new and useful door stop apparatus for a vehicle including a cylinder rotating in a block and a bar extending through the rotating cylinder.

DESCRIPTION OF THE PREFERRED EMBODIMENT

Figure 1:
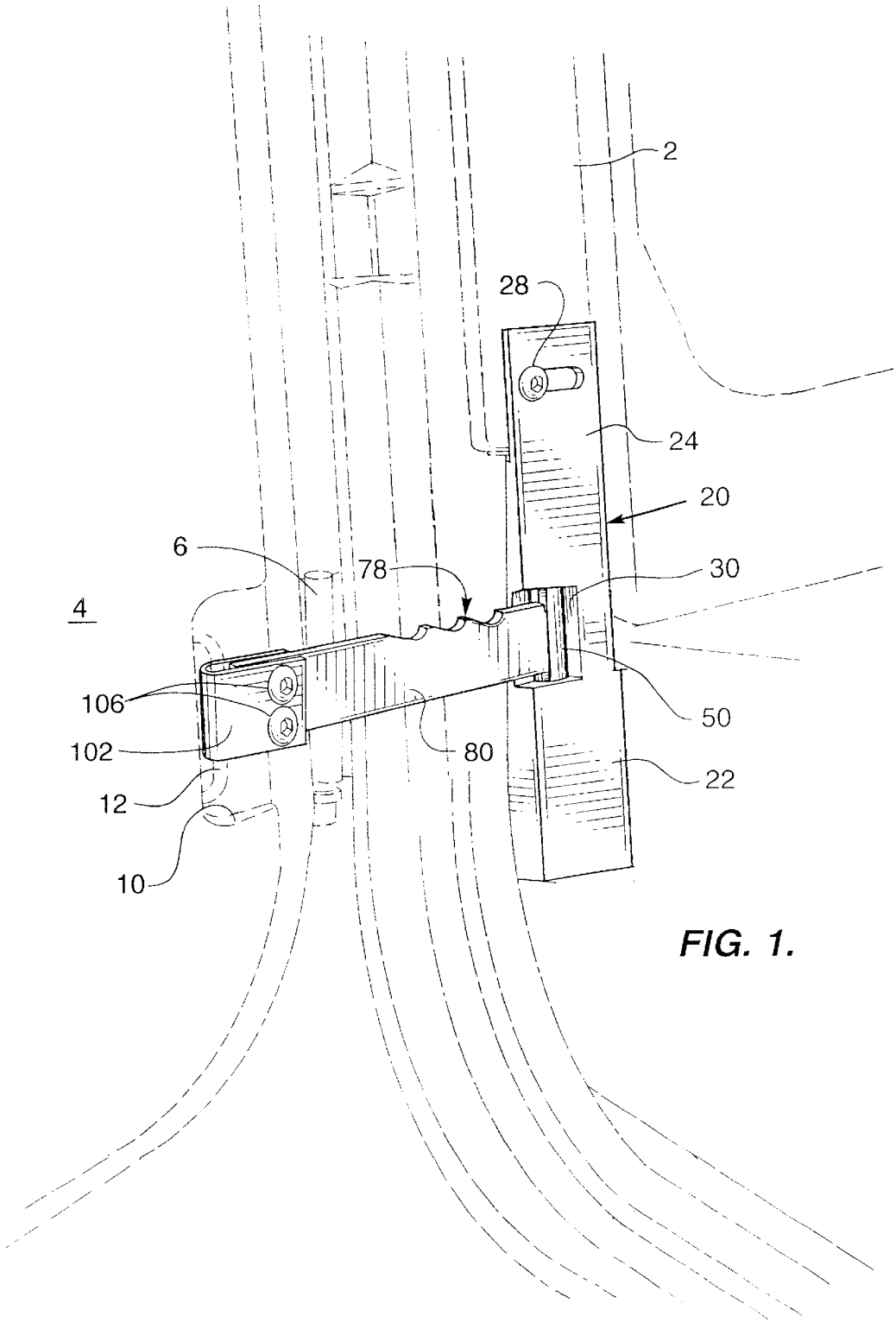
FIG. 1 is a perspective view of the apparatus of the present invention in the use environment.

FIG. 1 is a perspective view of stop apparatus 20 of the present invention shown in its use environment, namely secured to a vehicle chassis door frame the panel 2 and to a vehicle door 4. The vehicle door 4 is secured to the vehicle chassis by a pair of hinges, of which a hinge 6 is shown in FIG. 1.

In the door is a strap bracket depression 10, and a strap bracket 12 is secured to the door within the depression 10.

Figure 2:
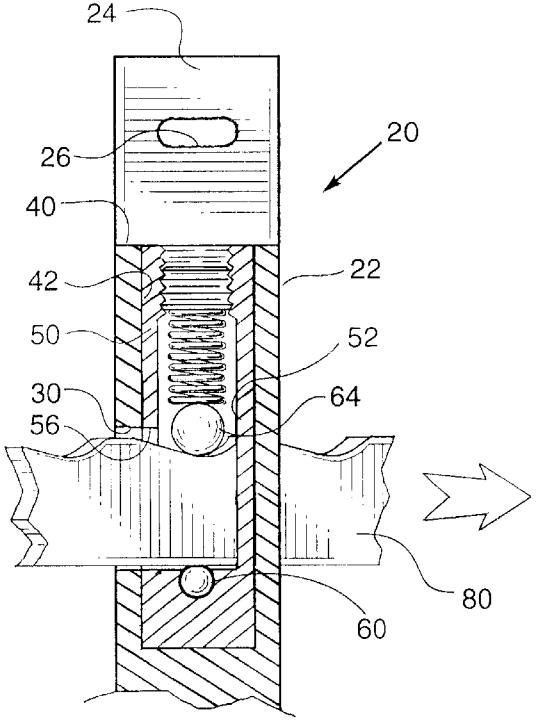
FIG. 2 is a view in partial section of the apparatus of the present invention.

FIG. 2 is a view in partial section of the door stop apparatus 20. For the following discussion, reference may be made to both FIGS. 1 and 2.

The door stop apparatus 20 includes a block 22. For securing the block 22 to the vehicle chassis door frame panel 2, there is a mounting flange 24 extending upwardly on the block. A bolt hole 26 extends through the mounting flange 24.

In FIG. 1, a fastening element, bolt or screw, 28 is shown extending through the hole 26 of the flange 24 and into the panel 2.

A generally horizontal and somewhat diagonal bore 30 extends through the block 22. Adjacent to the mounting flange 24 is a block top surface 40. Extending downwardly from the top surface 40 is a vertical bore 42. The vertical bore 42 communicates with the horizontal bore 30. The vertical bore 42 actually extends below the horizontal bore 30. A cylinder 50 is rotatably disposed within the bore 42.

Figure 3:
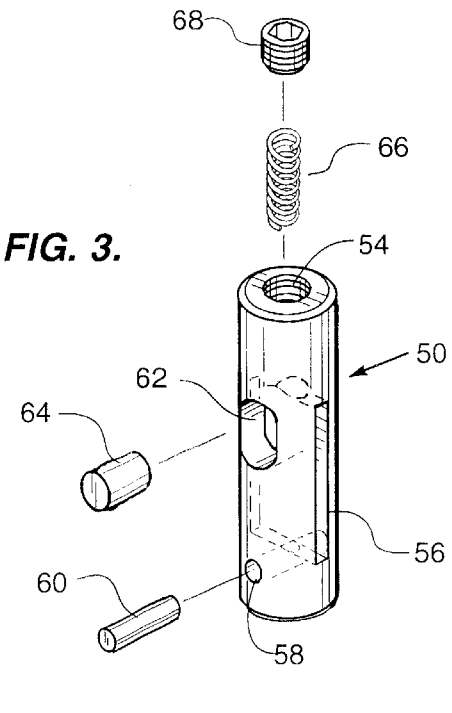
FIG. 3 is an exploded perspective view of a portion of the apparatus of the present invention.

FIG. 3 is an exploded perspective view of the cylinder 50 and its associated elements. For the following discussion, reference will primarily be made to FIGS. 2 and 3. Reference may also be made to FIG. 1.

The cylinder 50 includes a vertical bore 52 which extends downwardly from the top of the cylinder 50. The vertical bore 52 includes a top threaded portion 54. A horizontal bore 56 extends through the cylinder 50 and communicates with the vertical bore 52. While the vertical bore 52 is generally cylindrical or circular, the horizontal bore 56 is generally rectangular. The bores 56 and 52 intersect each other.

Another pair of bores, a lower roller bore 58 and an upper roller bore 62 extend into the cylinder 50 generally perpendicular to the horizontal bore 56. The bores 58 and 62 intersect the bore 56 at the bottom or lower portion of the bore 56 and adjacent to the upper portion of the bore 56. A roller 60 extends into the lower bore 58 and a roller 64 extends into the bore 62.

A spring 66 is disposed against the roller 64 for providing a bias on the roller 64 against a top surface 86 of a bar 80. The bar 80 is part of a bar assembly 78, which will be discussed below.

A set screw 68 engages a threaded upper portion 54 of the vertical bore 52. The extent to which the set screw 68 is adjusted in the threaded portion 54 varies the pressure of the spring 66 against the top surface 86 of the bar 80.

To allow the roller 64 to move under the bias of the compression spring 66, the bore 62 is slightly elongated in the vertical direction to allow for movement of the roller 64. The reason for the vertical movement of the roller 64 may be understood with reference to Figs. 1, 2, and 4.

Figure 4:
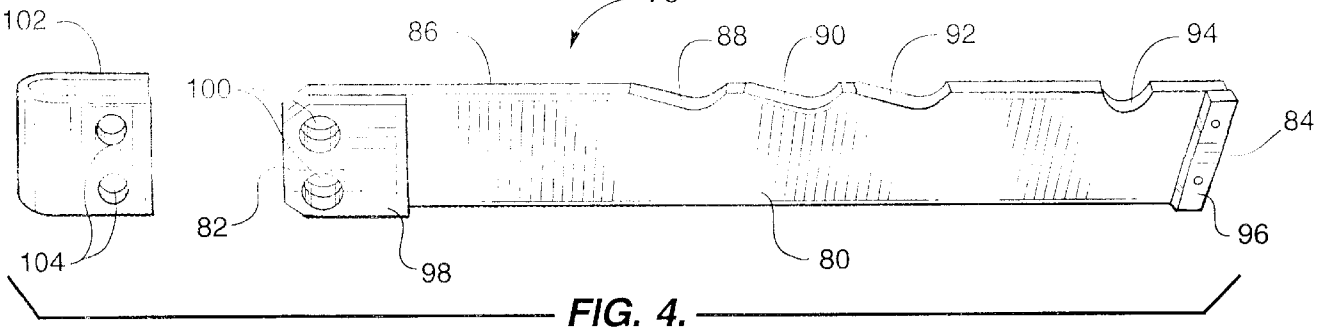
FIG. 4 is an exploded perspective view of another portion of the apparatus of the present invention.

FIG. 4 is an exploded perspective view of the bar assembly 78. The bar assembly 78 includes the bar 80 and a U-clamp 102. For the following discussion, reference will primarily be directed to FIG. 4, but reference may also be made to FIGS. 1, 2, and 3.

The bar 80 includes an outer end 82 and an inner end 84. The terms "outer" and "inner" refer to the bar with respect to the door 4 and to the vehicle chassis door frame panel 2.

As indicated in FIG. 1, the bar 80 extends through the horizontal, diagonally extending bore 30 in the block 22. The bar 80 also extends through the horizontal bore 56 in the cylinder 50. With the cylinder 50 disposed in the vertical bore 42 of the block 22, the horizontal bores 30 and 56 are generally aligned, as best shown in FIG. 2.

The bar 80 includes a top surface 86, and three intermediate stop depressions 88, 90, and 92 extend downwardly into the bar 80 from the top surface 86. The intermediate stop depressions 88, 90, and 92, are relatively shallow depressions and their leading portion, or the portion of the depressions facing towards the outer end 82 of the bar 80 are at a relatively gentle sloping angle. A rear stop depression 94, which comprises an outer limit depression, or a door wide open depression, also extends downwardly into the bar 80 from the top surface 86. The depression 94 does not includes the gently sloping portions as do the depressions 88, 90, and 92.

The depressions 88, 90, 92, and 94 receive the upper roller 64 for purposes of holding the door 4 in various open positions or locations or orientations. The outer limit depression 94 receives the roller 64 when the door 4 is at its widest opening, or at its wide open location.

When the roller 64 is disposed in the depression 94, an inner end stop element 96 is disposed against an outer surface of the block 66 adjacent to the rear portion of the horizontal bore 30 of the block 22. The inner end stop element 96 is appropriately secured to the bar 80.

At the outer or front end 82 of the bar 80 there is a reinforcing outer end fastener element appropriately secured to the bar 80. A pair of fastener apertures 100 extend through the element 98 and the bore 80.

A U-shaped clamp 102 is disposed about the strap bracket 12 and is secured to the bar 80 by appropriate fastener elements 106, shown in FIG. 1. A pair of fastener apertures 104, aligned with the fastener apertures 100 of the bar 80, receive the fasteners 106 to secure the U-clamp to the bar 80.

The cylinder 50 rotates in the bore 42 of the block 22 as the door 4 is moved between its closed position and its open position. The rotating movement of the cylinder 50, of course, moves in response to the pivoting of the bar 80 as the door moves.

As the door 4 moves outwardly a first distance, the spring biased roller 64 moves downwardly into the depression 88, and holds the door in that first position. As the door is moved outwardly a greater distance, the roller 64 moves out of the depression 88, along the tops 86 of the bar 80 and into the second depression 90. As the door is moved outwardly further, the roller 64 moves out of the depression 80, and along the top 86 and into the depression 92.

Finally, if it is desired to open the door to its widest open position, the roller 64 is moved out of the depression 92, farther along the top 86 and into the outer limit depression 94. There is a positive movement of the roller 64 both into and out of the depression 94. The positive movement is, of course, in response to the configuration of the depression 94 and to the bias on the roller 64 by the spring 66.

Movement of the bar 80 is relatively smooth on the bottom roller 60. The bottom roller 60 moves or rotates easily in its bore 58 at the bottom of the horizontal bore or slot 56 in the cylinder 50. The rollers 60 and 64 move freely and accordingly there is relatively little drag of the bar 80 as it moves in the cylinder 50 and in the block 22. The stop depressions 88, 90, 92 and 94 provide a holding friction to appropriately hold the door in the location or position or in the orientation as desired by a user of the vehicle and the apparatus 20.

While the principles of the invention have been made clear in illustrative embodiments, without departing from those principles, there may occur to those skilled in the art modifications of structure, arrangement, proportions, the elements, materials, and components used in the practice of the invention, or otherwise, which are particularly adapted to specific environments and operative requirements without departing from those principles. The appended claims are intended to cover and embrace any and all such modifications, within the limits only of the true spirit and scope of the invention.

What I claim is:

1. Vehicle door limiting apparatus comprising in combination:

a block adapted to be secured to a vehicle;

a first bore extending generally transversely through the block;

a second bore extending generally vertically through the block and communicating with the first bore;

cylinder means disposed in the second bore and in the first bore for rotating in the second bore including a cylinder rotatable in the second bore;

a third bore in the cylinder extending generally transversely and communicating with the first bore in the block; and bar means for moving in the first, second, and third bores extending through the first bore in the block and through the second and third bores in the cylinder, including a bar, a first end securable to the vehicle door, a second end remote from the first end, and a limiting element on the second end and disposed against the block to limit the extent of the opening of the vehicle door.

2. The apparatus of claim 1 in which the bar means further includes a top edge on the bar and at least a single stop recess on the top edge between the first end and the second end.

3. The apparatus of claim 2 in which the cylinder further includes:

a fourth bore communicating with the third bore, a first roller in the fourth bore and disposed on the top edge of the bar, and a spring for biasing the first roller into the stop recess on the bar for providing an intermediate stop for the vehicle door between a closed and an open position.

4. The apparatus of claim 3 which further includes a second roller in the fourth bore beneath the bar and substantially perpendicular to the bar on which the bar moves diagonally through the block.

5. The apparatus of claim 3 in which the cylinder rotates in the first bore as the vehicle door moves between its closed and open positions.

6. The apparatus of claim 1 in which:

the bar means includes a top edge and a plurality of stop recesses spaced apart from each other on the top edge; and the cylinder means further includes a first roller extending generally perpendicularly to the third bore and disposed on the top of the bar at the top edge, a second roller extending generally perpendicularly to the third bore and disposed at the bottom of the bar, and the bar rolls on the second roller as the bar moves as the vehicle door moves between a closed and an open position.

7. The apparatus of claim 6 in which the cylinder means further includes a fourth bore and a compression spring in the fourth bore for biasing the first roller against the top of the bar and successively into the stop recesses on the bar as the vehicle door moves between its closed and open positions.

8. The apparatus of claim 7 in which the cylinder means further includes a threaded portion in the third bore above the first roller and a set screw disposed in the threaded portion for providing a bias on the compression spring for urging the first roller into a stop recess to hold the vehicle door at a desired location between the closed and open positions of the vehicle door.

9. The apparatus of claim 1 which further includes means for securing the block to the vehicle adjacent to the vehicle door.

* * * * *

UNITED STATES PATENT AND TRADEMARK OFFICE

CERTIFICATE OF CORRECTION

PATENT NO. : 6,711,778 B2
DATED : March 30, 2004
INVENTOR(S) : Bennie W. Sparkman It is certified that error appears in the above-identified patent and that said Letters Patent is hereby corrected as shown below:

Title page
Item [75], Inventors, should read:
-- Bennie W. Sparkman --

Signed and Sealed this

Twenty-second Day of June, 2004

JON W. DUDAS
*Acting Director of the United States Patent and Trademark Office*